United States Patent [19]

Bandoch et al.

[11] 4,014,187

[45] Mar. 29, 1977

[54] FABRIC SPREADER FOR CIRCULAR KNITTING MACHINE

[75] Inventors: Rudolf Bandoch, Bilovice; Miroslav Marecek; Otto Rotkerl, both of Brno, all of Czechoslovakia

[73] Assignee: Vyzkumny a vyvojovy ustav Zavodu vseobecneho strojirenstvi, Brno, Czechoslovakia

[22] Filed: Sept. 11, 1974

[21] Appl. No.: 505,002

[30] Foreign Application Priority Data

Sept. 12, 1973 Czechoslovakia ..... 6301/73

[52] U.S. Cl. ..... 66/147; 26/82

[51] Int. Cl.[2] ..... D04B 35/00

[58] Field of Search ..... 66/147, 149 R, 151, 66/152; 26/55 R, 55 C, 56, 82

[56] References Cited

UNITED STATES PATENTS

| | | | |
|---|---|---|---|
| 2,585,762 | 2/1952 | Gardner | 66/151 |
| 2,798,515 | 7/1957 | York | 26/55 R |
| 3,119,168 | 1/1964 | Fleissner | 26/55 R |
| 3,162,028 | 12/1964 | Egerton et al. | 66/151 |
| 3,218,829 | 11/1965 | Seiler | 66/147 |
| 3,616,502 | 11/1971 | Aronoff | 26/55 R |

FOREIGN PATENTS OR APPLICATIONS

| | | | |
|---|---|---|---|
| 2,130,660 | 12/1972 | Germany | 66/147 |
| 447,158 | 10/1966 | Japan | 26/55 R |

*Primary Examiner*—Mervin Stein
*Assistant Examiner*—A. M. Falik

[57] ABSTRACT

Fabric spreader for knitted goods on a circular knitting machine. The fabric spreader is provided with expanding wings which are pivotably and adjustably supported on a fabric spreader frame and are adjustably spring-loaded with respect to the force generated by the knitted goods being taken up.

5 Claims, 5 Drawing Figures

Fig. 3
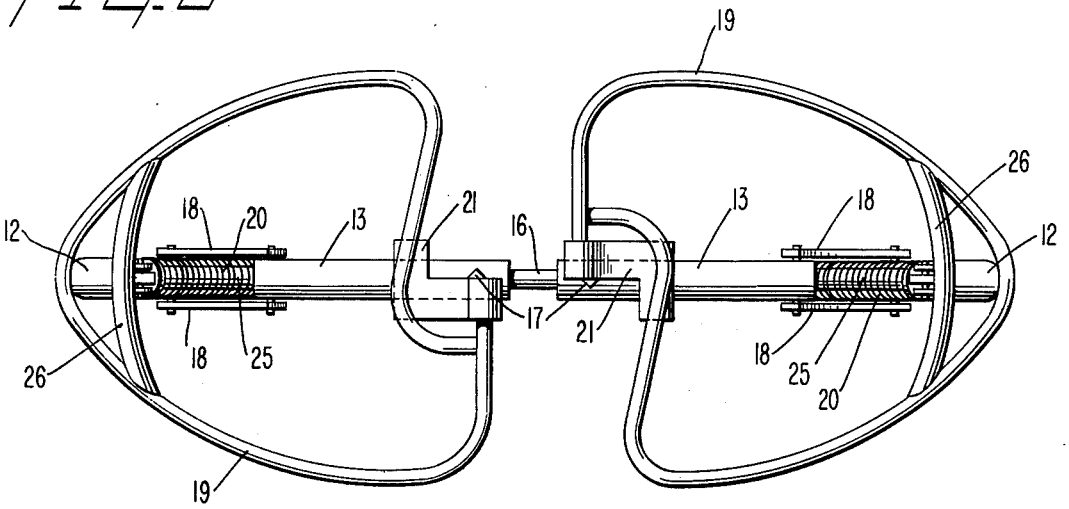
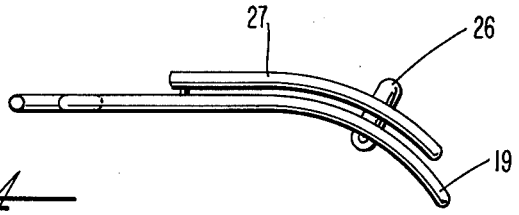
Fig. 4
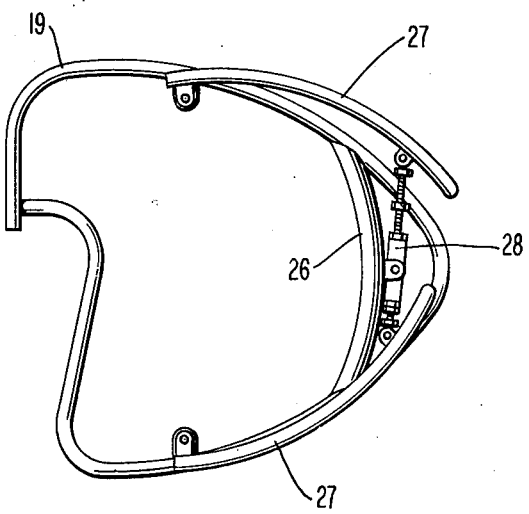
Fig. 5

FABRIC SPREADER FOR CIRCULAR KNITTING MACHINE

BACKGROUND OF THE INVENTION

This invention relates to a fabric spreader for knitted goods arranged between the system of the main knitting elements of a circular knitting machine and its take-up rollers for the knitted goods.

The knitted goods has the shape of a hose at the moment of its origin in the system of the main knitting elements of a circular knitting machine. Prior to its entrance between the take-up rollers and while it is being wound on the roller for the knitted goods, its shape has to be changed by the fabric spreader to a planar shape. Fabric spreaders of known design consist generally of stable expanding elements of circular or oval shape which are adjustable in width. Some known fabric spreaders are, in addition to these expanding elements, also provided with flat springs. But all these known fabric spreaders have one drawback, particularly in cases in which the distance between the take-up rollers and the place of origin of the knitted goods is small. A non-uniform tension is generated in the take-up knitted goods in the wales simultaneously with a resulting non-uniform entrance of the knitted goods into the take-up rollers. These non-uniformities are fixed in the knitted goods after the winding of the knitted goods on the roller, and can be removed prior to its further treatment with great difficulties only, particularly with synthetic materials.

SUMMARY OF THE INVENTION

It is an object of this invention to provide a fabric spreader for circular knitting machines which would eliminate this drawback to a high degree. The expanding wings of the fabric spreader according to this invention are pivotably and adjustably supported on the fabric spreader frame and are adjustably spring-loaded with respect to the force generated by the forcibly taken-up knitted goods.

A main advantage of the fabric spreader according to this invention is that the tension in the wales of the taken-up knitted goods is uniform to a maximum degree and the entrance of the wales of the knitted goods into the take-up rollers is also uniform. Thus deflections of the wales in the knitted goods wound on the take-up roller for the knitted goods is eliminated to a high degree and its further treatment is made easier.

DESCRIPTION OF THE DRAWINGS

An exemplary embodiment of the object of this invention is shown in the attached drawings, wherein

FIG. 3 shows the fabric spreader as in FIG. 2 in top view; and

FIGS. 4 and 5 show another example of the expanding wing of the fabric spreader, FIG. 4 being an elevation and FIG. 5 being a top view.

DESCRIPTION OF PREFERRED EMBODIMENTS

Figure 1:
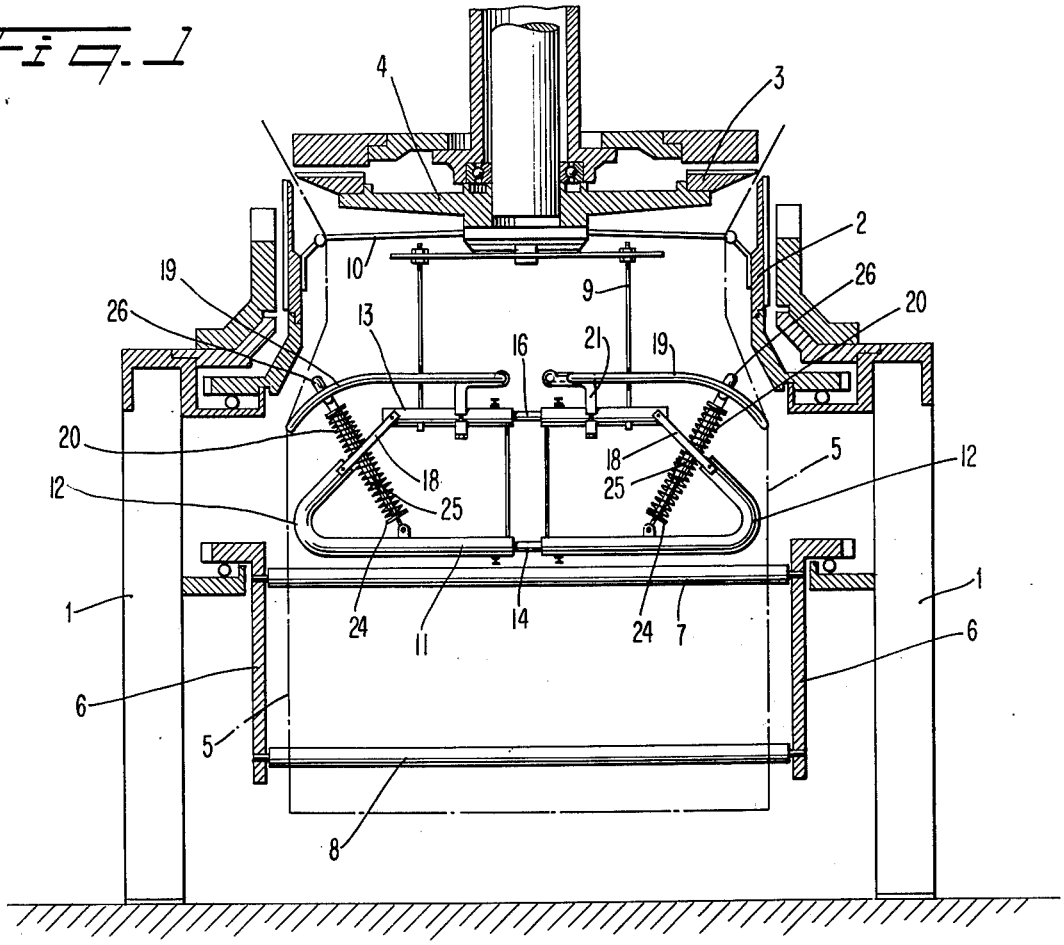
FIG. 1 represents a simplified schematic sectional elevation of a circular knitting machine with a fabric spreader according to this invention.

FIG. 1 shows a simplified circular knitting machine, a system of main knitting elements forming a knitted good of a hose shape being supported in the upper part of the frame of the machine. In the drawing, for the sake of simplicity, the system of main knitting elements is represented solely by a rotatably supported cylindrical needle bed 2 and by a dial needle bed 3 with its support 4. The take-up device for the knitted goods 5 consists of a rotatably supported driven support 6 of the take-up device for both the take-up rollers 7 for removal of the knitted goods 5 and a roller 8 for the winding on of the knitted goods 5 provided below the dial needle bed 3. The drive of the dial needle bed 3, of the cylindrical needle bed 2, of the support 6 of the take-up device, of the take-up rollers 7 and of the roller 8 for the winding on of the knitted goods 5, as well as the creel, is not shown for the sake of simplicity of the drawing.

The knitted goods 5 formed by the system of the main knitting elements and guided by a spacer ring 10 has the shape of a hose, and it is necessary to change this shape to a planar one for entrance between the take-up rollers 7. For this purpose, the fabric spreader for the knitted goods 5 is introduced in front of the take-up rollers 7. The fabric spreader is fixed to the rotatable dial needle bed 3 or to its support 4 by means of suspensions 9. The dial needle bed rotates synchronously with the take-up motion and the fabric spreader.

The fabric spreader for the knitted goods comprises expanding wings 19 arranged on an expanding frame of a flat shape, oriented transverse to the plane of the expanding wings 19 and advantageously adjustable as to its width. As is particularly shown in FIG. 2, the lower part of the frame consists, for example, of two tubes 11 with a rod 14 inserted into these tubes 11, secured adjustably for instance by screws 15. The tubes 11 have bent ends 12 for expanding the knitted goods 5 to a planar shape. The upper part of the frame consists equally of two tubes 13 with a rod 16 inserted into these tubes 13 and adjustably secured for instance by screws 17. The bent ends 12 of the tubes 11 of the lower frame part are connected with the tubes 13 forming the upper part of the frame for instance by struts 18.

Expanding wings 19 of substantially flat shape are supported by the expanding frame at least partially transverse to the take-up direction of the knitted goods 5. For a better expanding effect the expanding wings 19 are arranged on the expanding frame of the fabric spreader pivotably and are provided with power elements, for instance with springs 20, acting against the force generated by the expanded taken-up knitting goods 5.

Figure 2:
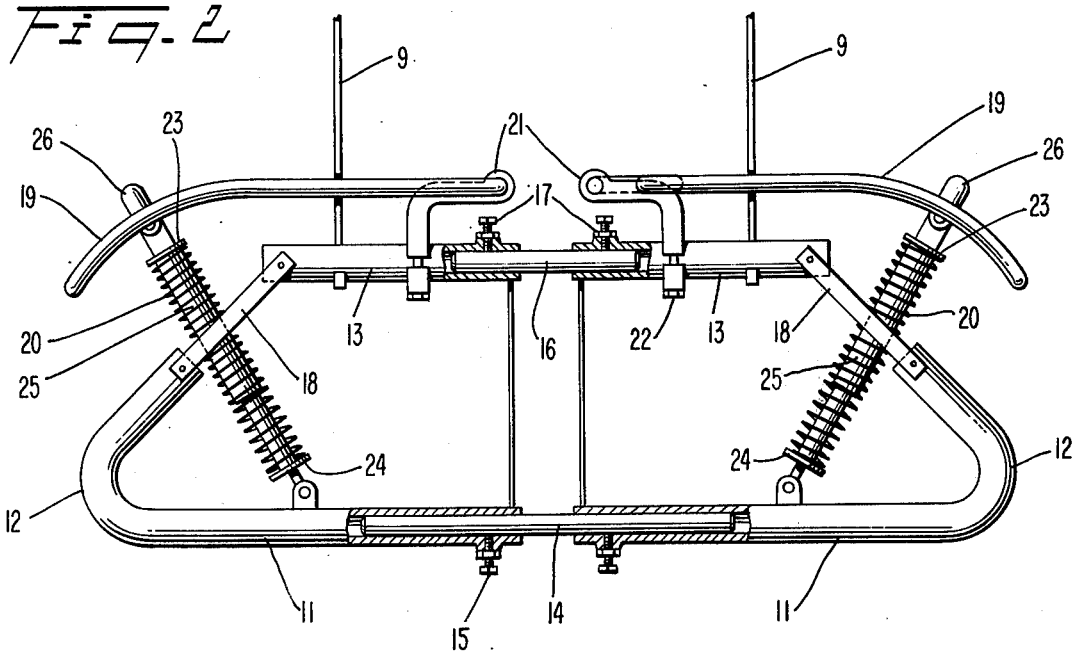
FIG. 2 shows the fabric spreader for the knitted goods in elevation.

In the exemplary arrangement of FIGS. 1–3, inclusive, each expanding wing 19 is pivotally supported on a sleeve 21. The sleeves 21 are slidably adjustably mounted on tubes 13 of the upper frame part, where they are secured by screws 22. It is thus possible to adjust the position of the expanding wings 19. The force acting on the expanding wing 19 against the force from the expanded knitted goods is provided by the spring 20 acting between the upper rest 23 and the lower rest 24 on a two-part telescopic arrangement 25 for adjustment of the force of the spring 20.

The upper rest 23 is arranged adjustably on the upper part of the telescopic arrangement 25, the lower rest 25 being adjustably arranged on the lower part of the telescopic arrangement 24. The adjustment of the force of the spring 20 is accomplished by conventional means, e.g., both the upper and lower part of the telescopic arrangement are provided with a thread (not shown) and the rests 23, 24 are screwed on, i.e., they are provided with inner threads such as nuts. Alternatively, there may be provided grooves in the lower and upper parts of the telescopic arrangement 25 and the rests 23, 24 are secured by means of resilient securing rings disposed in their respective grooves.

The lower part of the two-part telescopic arrangement 25 is pivotably supported on the tube 11 of the lower part of the expanding frame of the fabric spreader, and the upper part of the telescopic arrangement 25 is pivotably supported on the expanding wing 19, for instance on its transverse rod 26. The stroke of the telescopic arrangement 25 is adjustable for example so that the lower adjustable rest 24 of the spring 20 is simultaneously a stop for the telescopic arrangement 25.

The proper shape of the expanding wings 19 is advantageously that of an isosceles triangle, the base of which is swingable in the sleeve 21 on the expanding frame and at least one of its apexes and its legs are rounded. According to FIG. 2, this triangle can be spatial so that its legs extend in a direction toward the apex, receding with respect to the base in the direction of take-up of the knitted goods 5.

As shown in FIGS. 4 and 5, there is furthermore a possibility of providing the expanding wing 19 with an adjustment of its width, thus enabling the increasing of the area of the expanding wings 19. In FIGS. 4 and 5 this is indicated by the provision of pivotably supported extending segments 27, which are adjustable to the required position by set screws 28, supported rotatably on the respective transverse rod 26 and the respective segment 27. The segment 27 can, of course, also be spring-loaded.

The possibility of a universal adjustment of the functional dimensions of the fabric spreader by adjustment of the expanding wings 19, of their pivotable support, of their springing, of their expanding area and the like operate to adjust the fabric spreader for different materials and bindings of knitted goods formed on circular knitting machines.

Although the invention is illustrated and described with reference to a plurality of preferred embodiments, it is to be expressly understood that the invention is in no way limited to the disclosure of such a plurality of preferred embodiments, but is capable of numerous modifications within the scope of the appended claims.

What is claimed is:

1. In a fabric spreader for goods knitted on a circular knitting machine, said machine having a system of main knitting elements and means for taking up the knitted goods under tension, the fabric spreader being disposed between the main knitting elements and the take-up means, the fabric spreader comprising a flat expanding frame adjustable in width, a plurality of flat expanding wings carried by the frame and situated transverse to the taken-up knitted goods, means coupled to an inner portion of each wing for slidably mounting the associated wing for transverse movement on the frame, additional means associated with the slidable mounting means for pivotally supporting the associated wing on the frame, and means individually connected to respective portions of each wing and independent of the slidable mounting means and the pivotal supporting means for adjustably spring-loading the associated wing on the frame against the force exerted on such wing by the taken-up goods.

2. A fabric spreader as in claim 1, wherein the expanding wings have the shape of an isosceles triangle the base of which is situated on the expanding frame and at least one apex of which is rounded with respect to the base and the legs, respectively, the legs receding with respect to the base in the take-up direction of the knitted goods.

3. A fabric spreader as in claim 2, wherein at least a part of the surface of the expanding wing is arched into the taken-up knitted goods.

4. A fabric spreader as in claim 1, wherein the expanding wings are provided with projecting segments for adjustably varying the degree of expansion of the expanding wings.

5. A fabric spreader as defined in claim 1, in which each spring-loading means comprises a two-part telescopic arrangement situated between the outer portion of the associated wing and the frame.

* * * * *